United States Patent [19]

Robinson et al.

[11] Patent Number: 4,506,530

[45] Date of Patent: Mar. 26, 1985

[54] KEY-OPERATED LOCK

[75] Inventors: William K. Robinson, Coven; Malcolm J. White, Parkside, both of England

[73] Assignee: Chubb & Son's Lock and Safe Company Limited, London, England

[21] Appl. No.: 501,229

[22] Filed: Jun. 6, 1983

[30] Foreign Application Priority Data

Jun. 9, 1982 [GB] United Kingdom ..... 8216725

[51] Int. Cl.[3] ..... E05B 35/08

[52] U.S. Cl. ..... 70/338; 70/355

[58] Field of Search ..... 70/337–339, 70/143, 355

[56] References Cited

U.S. PATENT DOCUMENTS

| | | | |
|---|---|---|---|
| 653,946 | 7/1900 | Colletti et al. | 70/143 X |
| 869,533 | 10/1907 | Taylor | 70/339 |
| 1,935,225 | 11/1933 | Hurd | 70/355 |
| 3,473,355 | 10/1969 | Saito | 70/339 |

FOREIGN PATENT DOCUMENTS

| | | | |
|---|---|---|---|
| 115324 | 12/1968 | Norway | 70/339 |
| 640585 | 7/1950 | United Kingdom | 70/355 |

*Primary Examiner*—Gary L. Smith
*Assistant Examiner*—Thomas J. Dubnicka
*Attorney, Agent, or Firm*—Pollock, Vande Sande and Priddy

[57] ABSTRACT

In a security door lock a pivoted detent deadlocks the bolt by engagement of a stump in pockets provided in the bolt. The detent is normally held in its locking position by a cam surface on the thrower and by a pack of detainers. Rotation of the correct key aligns notches in the detainers with a probe on the detent and also positions a second cam surface of the thrower adjacent to the detent, so the detent can pivot to its unlocking position under the action of a spring, and thereby free the bolt. After the bolt is shifted the final rotation of the key re-engages the cam surface against the detent to drive the detent positively back to its locking position. If required, the bolt can be double-thrown by a second ("master") key which lifts the detainers to higher positions so that second notches in the detainers now align with the detent probe. This higher lifting of the detainers also lifts a dogging slide so that the stump of the latter can pass over a projection on the bolt tail. The first ("servant") key cannot lift the detainers far enough to lift the slide and hence cannot throw or withdraw the bolt to or from its double-thrown position.

6 Claims, 4 Drawing Figures

KEY-OPERATED LOCK

The present invention relates to locks and particularly, though not exclusively, is concerned with high security key-operated door locks.

In accordance with one aspect of the invention a lock comprises: a bolt adapted to be thrown and withdrawn by the turning of a correct key; a key-recognition mechanism comprising a plurality of movable detainers adapted to be set in predetermined relative positions when engaged by a correct key during the turning thereof; a movable detent associated with said detainers which is arranged normally to lie in a first position in which it blocks movement of the bolt, at least when the bolt is in a thrown condition, the detent being biased resiliently towards a second position in which it can release the bolt but movement of the detent into its said second position being permitted by the detainers only when the latter are set in their said predetermined relative positions; and a cam member rotatable by a correct key which cam member operates normally to maintain the detent in its said first position, but to permit the detent to move into its second said position when the key is turned such as to set the detainers in their said predetermined relative positions, and to return the detent against said resilient bias to lie in its said first position after corresponding movement of the bolt. Preferably, the cam member is constituted by a thrower which acts also in the transmission of turning movement of a correct key into corresponding rectilinear movement of the bolt.

In a preferred embodiment of a lock according to the invention the bolt is arranged to be movable from a first, withdrawn position to a second, thrown position and thence to third, double-thrown position; and it is arranged that a first correct key is effective to move the bolt between its first and second positions and a second correct key (but not the first correct key) is effective to move the bolt between its second and third positions. Preferably in such an embodiment the first correct key is adapted to set the detainers in first predetermined relative positions and the second correct key is adapted to set the detainers in second predetermined relative positions, in either of which the detainers permit movement of the detent from its first to its second position as aforesaid; a further movable member is provided which is biased into a position in which it can permit movement of the bolt between its first and second positions but blocks movement of the bolt between its second and third positions; and it is arranged that the detainers, when set into their second said predetermined relative positions, are effective to move the further member out of its said position to permit movement of the bolt between its second and third positions, but that the detainers, when set into their first said predetermined relative positions, are ineffective to move the further member as aforesaid.

An illustrative embodiment of the invention, in the form of a mortice door lock, will now be more particularly described with reference to the accompanying drawings, in which.

In the following description all expressions of relative direction or position, such as "clockwise", "anticlockwise", "upper", "lower", "leftwards", "rightwards", and "reverse side" are given in terms of the lock as viewed from the standpoint of the Figures.

Figure 1:
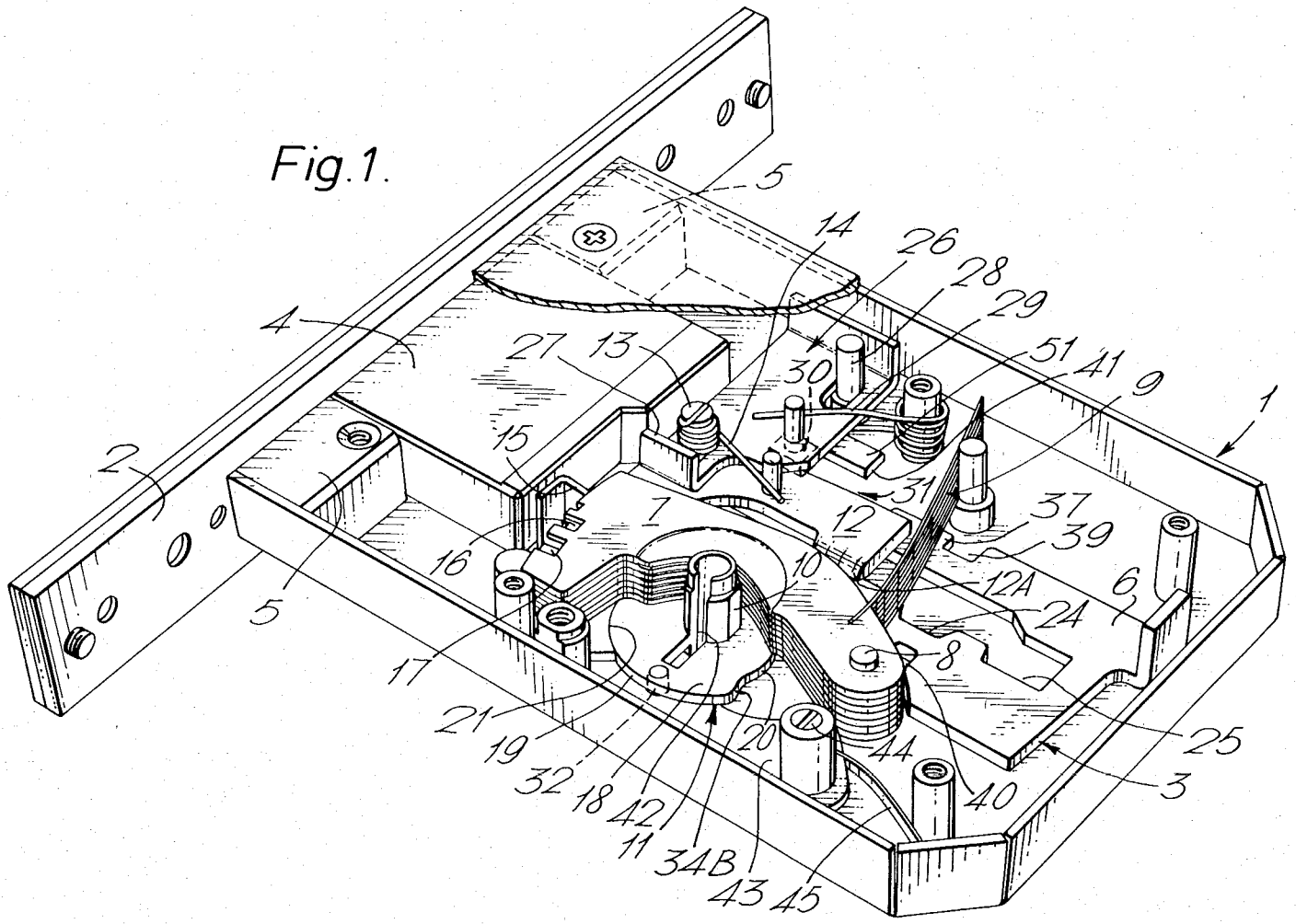
FIG. 1 is a perspective view of the lock mechanism in a first position, with part of the lock case removed.

Referring to FIG. 1, there is a lock with a case 1, forend 2 and reciprocable bolt 3. The bolt has a head 4 borne between running blocks 5 in the case 1, and a plate-like tail 6. The key-recognition mechanism of the lock includes a pack of detainers 7 pivoted together on a pin 8 and biased in the anticlockwise sense by a pack of leaf springs 9, so as normally to rest upon the stem 10 of a thrower 11. Associated with the detainers is a detent 12 which is pivoted on a pin 13 and biased in the anticlockwise sense by a spring 14. This detent has a transverse probe 15 which is pressed towards the detainers 7 by the action of the spring 14, but the detent is prevented from moving further anticlockwise out of its illustrated position except when the detainers are correctly aligned to permit the probe 15 to enter either one of two notches 16/17 provided at different positions in the front face of each detainer 7. Furthermore, the probe 15 is normally held off from the detainers by means of a flange 18 on the thrower 11. The thrower flange 18 has two cam surfaces 19 and 20 of greater and lesser radius, respectively, (see also FIG. 2) and the surface 19 is normally positioned to engage a surface 21 of the detent and keep the detent in its illustrated pivotal position. In this position a projecting stump on the reverse side of the tail 12A of the detent (this stump being indicated at 22 in FIG. 3) engages in one of three recesses 23–25 in the bolt tail 6, depending upon the relative position of the bolt (as will be described more fully below), to deadlock the bolt.

In the particular form of lock shown in the Figures the bolt 3 can be double-thrown, and two separate keys (which, for convenience, we shall refer to as "servant" and "master" keys respectively) are required in order to achieve this action. More particularly, the servant key can throw the bolt from its withdrawn (first) position shown in FIG. 1 to an intermediate (second) position shown in FIG. 2, in which the bolt head 4 extends from the forend 2 by a certain distance to lock the door with which it is associated, and can return the bolt from its second to its first position; the master key can throw the bolt from its second position to its double-thrown (third) position in which the head 4 extends still further from the forend, and can return the bolt from its third to its second position; but the servant key must be incapable of moving the bolt in either sense between its second and third positions, and the master key must be incapable of moving the bolt in either sense between its first and second positions. In order to achieve these functions a further element 26, termed herein a "dogging slide", is provided. This slide is in the form of a plate with a flange 27 at its lower end and is borne by two pins 13 and 28 for limited axial movement at right angles to the movement of the bolt 3. A spring 29 biases the slide to its illustrated, lower position and a square peg 30 extends from the reverse side of the slide to lie, in the first position of the bolt, within axial slot 31 in the bolt tail 6 (see also FIG. 3).

The operation of the servant key to throw and withdraw the bolt 3, between its first and second positions, will now be described. Starting with the bolt in its first position as shown in FIG. 1, the key bit is engaged with the slot 42 in the thrower 11 and the latter is given one complete anticlockwise revolution. As the thrower turns a stage is reached where the detent 12 is released by the cam surface 19 (i.e. at the cam step 34A shown in FIG. 2), to pivot inwards against the detainers 7. By this stage, assuming that the correct key has been used, each detainer will have been lifted by the key bit by the requisite distance to align a selected one of its notches 16 or 17 (say the notch 16 in the case of the first detainer) with the probe 15. The detent 12 accordingly pivots under its spring bias to release its stump 22 from the recess 23 in the bolt tail (FIG. 3), as the probe 15 enters the detainer notches. Further rotation of the thrower 11 brings a pin 32, projecting from the reverse side of its flange 18 (see also FIG. 4), into engagement with a talon form 33 (FIG. 3) on the bolt tail 6, to shift the bolt leftwards into its second position illustrated in FIG. 2. During the final part of the thrower's movement the cam step 34B encounters the detent surface 21 to drive the detent clockwise against the bias of its spring 14, so that its stump now engages in recess 24 in the bolt tail 6 to deadlock the bolt in its second position (as indicated at 22′ in FIG. 3), and the detainers 7 are released by the key bit to drop back to their unlifted positions under the bias of springs 9. To withdraw the bolt to its first position the servant key is used to turn the thrower 11 through one complete clockwise revolution, in so doing the detainers 7 being lifted as before and the detent 12 pivoting to release its stump 22 from recess 24 and to re-engage it in recess 23 after the rightward movement of the bolt, the latter being by operation of the thrower pin 32 on a talon form 35 (FIGS. 2 and 3) of the bolt tail, and in this case the detent 12 being driven back to its deadlocking position by the step 34A between the thrower cam surfaces 20 and 19.

Throughout this use of the servant key the dogging slide 26 remains unmoved in its lower position and as the bolt moves between its first and second positions the peg 30 remains in the slot 31. When the bolt has been shifted to its second position however, the peg 30 is located at the open (rightward) end of the slot 31, adjacent to the lefthand face 36 of an upstand 37 on the top of the bolt tail 6, i.e. as shown at 30′ in FIG. 3. Further leftward movement of the bolt into its third position will be blocked by the peg 30, therefore, unless the slide 26 is lifted to take the peg above the top of the upstand 37, and this can be achieved only by use of the master key as will now be described.

Figure 2:
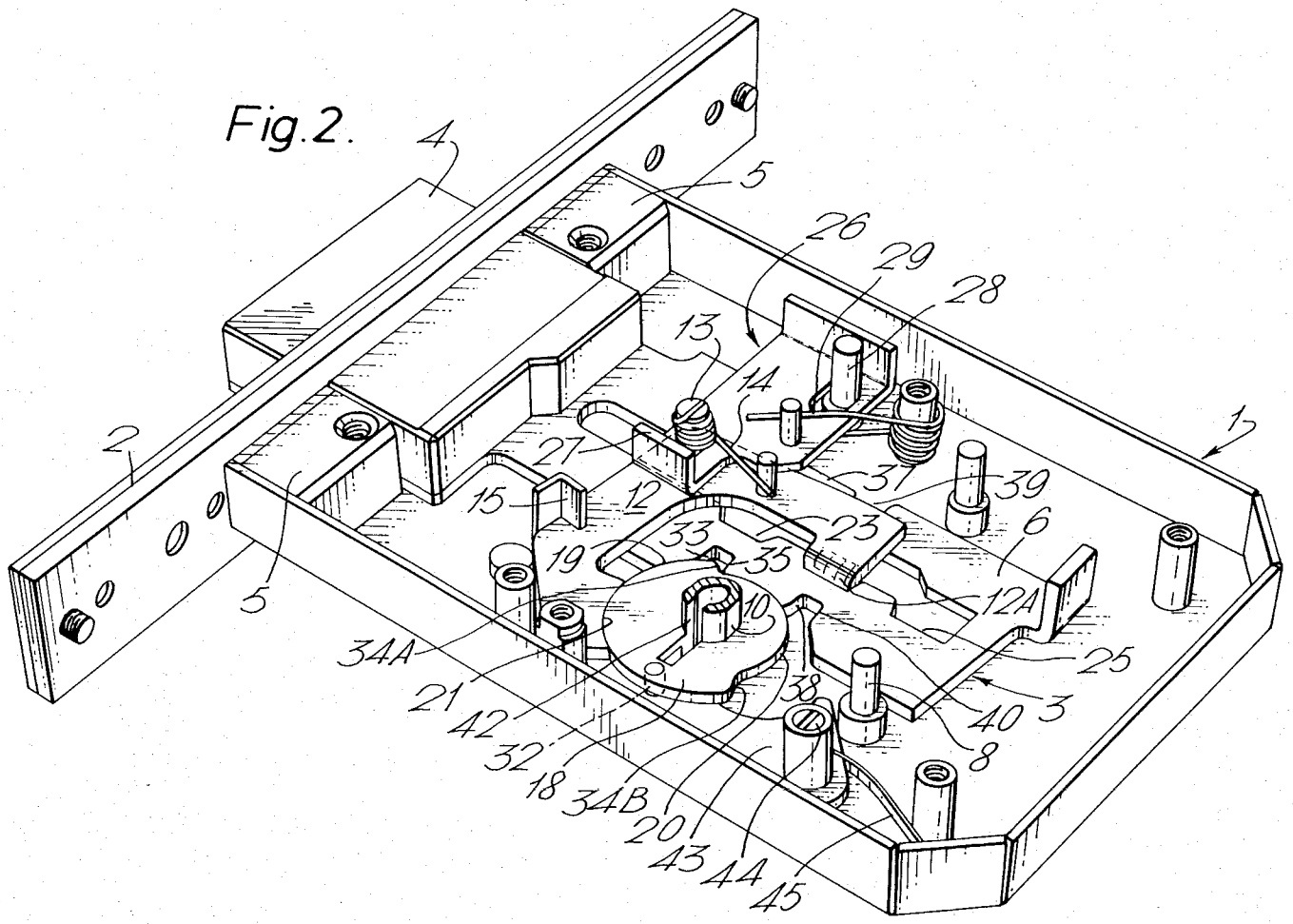
FIG. 2 is a perspective view of the lock mechanism in a second position, with the detainers omitted for clarity of illustration.
Figure 3:
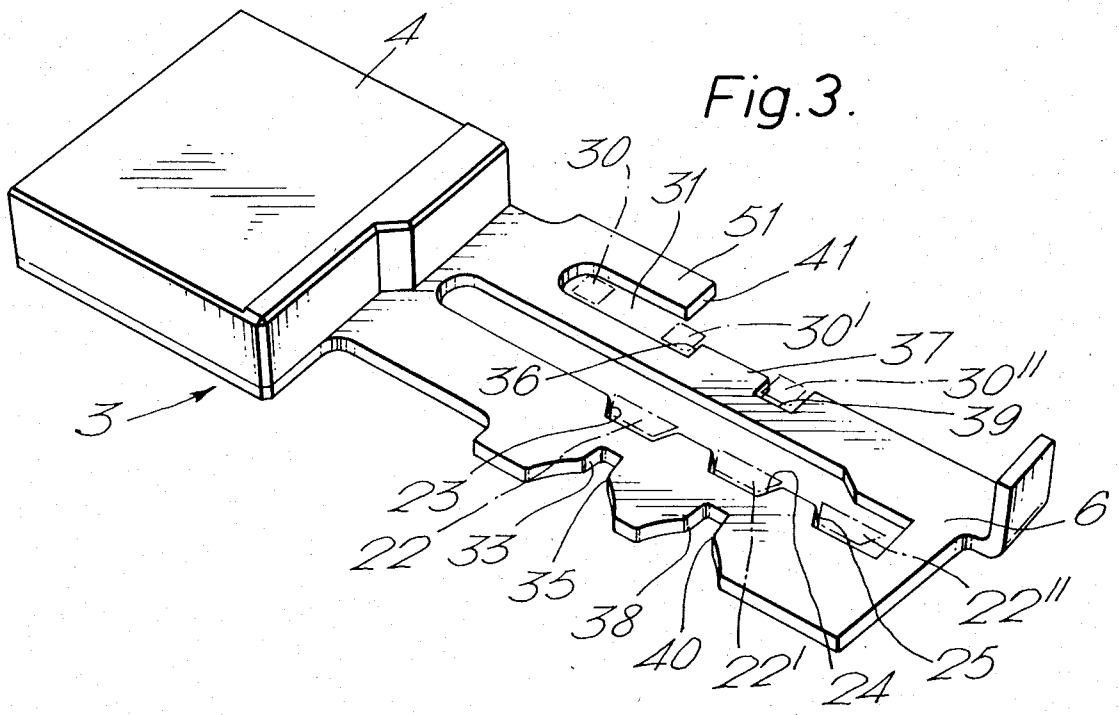
FIG. 3 is a perspective view of the bolt of the lock.

Assuming the bolt 3 to be in its second position, the master key bit is engaged with the thrower 11 and the latter is given one complete anticlockwise turn. The action of the thrower flange 18, detainers 7 and detent 12 during this movement, (the latter pivoting its stump 22 out of recess 24 and into recess 25 of the bolt tail as shown at 22″ in FIG. 3), is exactly the same as described above for the corresponding first-throw movement under the action of the servant key, except that in this case the master key is configured to lift each detainer by the requisite distance to align the other of its notches 16 or 17 (that is, the notch 17 in the case of the first detainer) with the detent probe 15. Furthermore, at least one of the detainers will be lifted in this movement by a distance greater than any of the lifts which are possible with the servant key, so that at least one detainer comes into contact with the flange 27 of the dogging slide to lift the slide so that its peg 30 moves up out of the slot 31 and permits the upstand 37 to pass underneath as the bolt moves leftward from its second to its third position. In this case the movement of the bolt is by operation of the thrower pin 32 on a talon form 38 (FIGS. 2 and 3). As the detainers 7 drop during the last part of the rotation of the thrower so also does the slide 26 drop under the bias of its spring 29, to engage the peg 30 in a recess 39 in the top of the bolt tail to the right of the upstand 27, i.e. as shown at 30″ in FIG. 3. To withdraw the bolt from its third to its second position the master key is used to turn the thrower 11 through one complete clockwise revolution, in so doing the detainers being lifted again, the detent 12 pivoting to release its stump 22 from recess 25 and re-engage it in recess 23, and the slide 26 being lifted to take its peg back over the upstand 37 and into the righthand end of the slot 31, as the bolt 3 is shifted rightwards by operation of the thrower pin 32 on a further talon form 40.

In use of the above described lock, it will be seen that to shift the bolt in either sense between its second and third positions it is necessary to lift the dogging slide 26. It is arranged that under no circumstances can the servant key lift any detainer 7 sufficiently far to achieve this function, which therefore precludes use of the servant key to double-throw the bolt or to release the bolt from its double-thrown position. Equally, use of the master key to shift the bolt in either sense between its first and second positions is precluded. This is because, with the bolt in its first (withdrawn) position the slide 26 is prevented from lifting by the presence of its peg 30 in the slot 31, which means that at least one detainer 7 will also be prevented from lifting sufficiently to align its notch 17 with the detent probe 15. With the bolt in its second position the slide 26 can, of course, be lifted, and will be if the master key is turned clockwise from this position, but this action positions the peg 30 adjacent to the face 41 of the bolt tail (FIGS. 1 and 3) to block withdrawing movement of the bolt.

Figure 4:
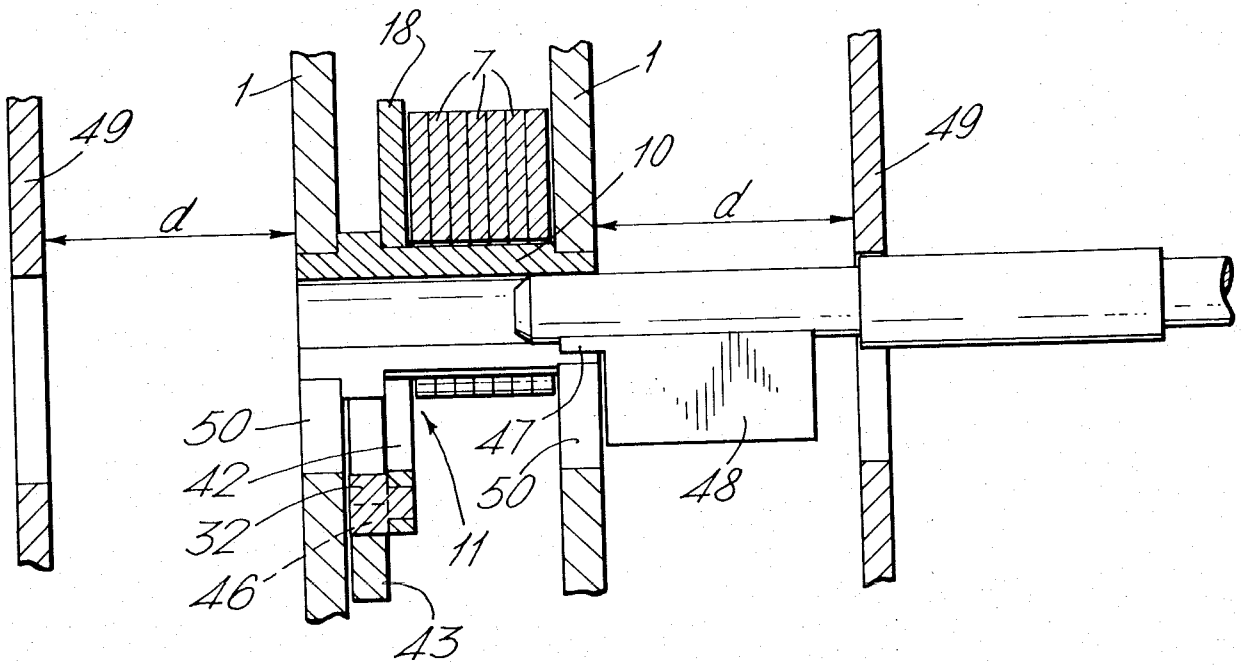
FIG. 4 is a section through part of the mechanism, showing also an associated (blank) key during insertion.

In normal operation of the lock, the thrower 11 commences and terminates each action in the same rotational position, i.e. with its key slot 42 vertically aligned, as illustrated. In order to assist in the correct positioning of the thrower a retaining member 43 is provided, this comprising a plate pivoted on a pin 44 and biased in the clockwise sense by a spring 45, and having a notch 46 (FIG. 4) into which the thrower pin 32 snaps when the thrower is correctly positioned. Nevertheless, a situation may arise in which, either through some accident or as the result of deliberate manipulation, the thrower is displaced from its starting position so that a correct key when offered to the lock in the correct orientation cannot engage the slot 42. In order that such a situation can be rapidly rectified the keys for use with this lock have a small lead-in portion 47 to their bit 48 as shown in FIG. 4, which can engage the outermost slot portion at either end of the thrower stem 10, where it is journalled in the lock case 1, while the main portion of the key bit 48 remains outside the lock case and is freely rotatable to any angular position. Any associated escutcheons such as indicated at 49 are spaced from the case 1 by a distance "d" sufficient to accommodate the whole of the key bit for rotation. The portion 47 of the key bit can be used, therefore, to pick up the thrower stem at whatever angular position it is disposed and to rotate the thrower back to its proper starting position whereupon the rest of the key bit 48 can pass through the respective key aperture 50 in the case 1 and engage the main thrower slot 42.

Although the lock as described above is configured to prevent the master key from moving the bolt in either sense between its first and second positions, in other embodiments it may be desirable to permit the master key to perform this function in addition to moving the bolt between its second and third position, while still preventing movement of the bolt by the servant key between its second and third positions. This can readily be catered for by omitting the portion 51 of the bolt tail (FIGS. 1 and 3) which defines the upper surface of the slot 31, thereby permitting the dogging slide 26 to be lifted in any one of the three positions of the bolt.

We claim:

1. A lock comprising a bolt adapted to be moved from a first, withdrawn position to a second, thrown position and thence to a third, double-thrown position, and arranged such that a first correct key is effective to move the bolt between its first and second said positions and a second correct key, but not the first correct key, is effective to move the bolt between its second and third said positions, the lock comprising: a key-recognition mechanism comprising a plurality of movable detainers adapted to be set in first predetermined relative positions when engaged by the first correct key during the turning thereof and to be set in second pretermined relative positions when engaged by the second correct key during the turning thereof; a movable detent associated with said detainers which is arranged normally to lie in a first position in which it blocks movement of the bolt; means for biasing said detent resiliently towards a second position in which it can release the bolt but movement of the detent into its said second position being permitted by the detainers only when the latter are set in their first or second said predetermined relative positions; a cam member rotatable by each said correct key which cam member is configured so as normally to maintain the detent in its said first position, but to permit the detent to move into its said second position when the respective correct key is turned such as to set the detainers in their first or second said predetermined relative positions, and to return the detent against said resilient bias to lie in its said first position after corresponding movement of the bolt; and a further movable member which is biased into a position in which it permits movement of the bolt between its first and second positions but blocks movement of the bolt between its second and third positions; the detainers, when set into their second said predetermined relative positions, being effective to move said further member out of its said position to permit movement of the bolt between its second and third positions, but the detainers when set into their first said predetermined relative positions, being ineffective to move the further member as aforesaid.

2. A lock according to claim 1 wherein the cam member is constituted by a thrower which acts also in the transmission of turning movement of each correct key into corresponding rectilinear movement of the bolt.

3. A lock according to claim 1 wherein the detent is pivotally mounted; a first portion of the detent bearing a probe which is capable of entering notches in the detainers when such are aligned by the setting of the detainers in their first or second said predetermined relative positions and the detent is freed by the cam member to move into its second said position; and a second portion of the detent bearing an abutment which normally engages with the bolt to block the movement thereof; the detent being arranged to pivot under said resilient bias to withdraw said abutment from engagement with the bolt when said probe enters said notches.

4. A lock according to claim 1 wherein said further movable member is associated with the bolt such that the bolt blocks movement of the further movable member out of its said position, and thereby prevents the detainers from being set into their second said predetermined relative positions by the second correct key, when the bolt is in its first position.

5. A lock according to claim 1 wherein said further movable member is associated with the bolt such that when the bolt is in its second position and the detainers are set into their second said predetermined relative positions to move the further movable member out of its said position, the further movable member blocks movement of the bolt into its first position.

6. A lock according to claim 1 wherein each said detainer comprises two notches into one of which a portion of said detent can enter when the detainers are set into their first said predetermined relative positions and into the other of which said portion of said detent can enter when the detainers are set into their second said predetermined relative positions, and it is arranged that when the detainers are set into their second said predetermined relative positions at least one such detainer is moved by the second correct key through a greater distance than any detainer is moved by the first correct key when setting the detainers into their first said predetermined relative positions, thereby to engage said further movable member and move the same out of its said position.

* * * * *